US006327818B1

(12) United States Patent
Pease

(10) Patent No.: US 6,327,818 B1
(45) Date of Patent: Dec. 11, 2001

(54) CROSSING GATE ARM PROTECTION ASSEMBLY

(75) Inventor: Ronald Pease, Hickory Hills, IL (US)

(73) Assignee: Western-Cullen-Hayes, Inc., Chicago, IL (US)

( * ) Notice: Subject to any disclaimer, the term of this patent is extended or adjusted under 35 U.S.C. 154(b) by 0 days.

(21) Appl. No.: 09/640,603

(22) Filed: Aug. 17, 2000

Related U.S. Application Data

(60) Provisional application No. 60/149,841, filed on Aug. 19, 1999.

(51) Int. Cl.[7] ..... E01F 13/00
(52) U.S. Cl. ..... 49/49
(58) Field of Search ..... 49/49, 386, 387, 49/138

(56) References Cited

U.S. PATENT DOCUMENTS

| | | | | |
|---|---|---|---|---|
| 873,162 | * | 12/1907 | McGladdery et al. | 49/49 X |
| 1,628,651 | * | 5/1927 | Burress | 49/49 X |
| 2,295,419 | * | 9/1942 | Miskelly | 49/13 X |
| 2,826,840 | * | 3/1958 | Cooper et al. | 49/386 |
| 4,124,955 | | 11/1978 | Kochis . | |
| 4,364,200 | | 12/1982 | Cobb . | |
| 4,897,960 | | 2/1990 | Barvinek et al. . | |
| 5,469,660 | | 11/1995 | Tamenne . | |
| 5,653,058 | | 8/1997 | Zaimins . | |

FOREIGN PATENT DOCUMENTS

| | | | | |
|---|---|---|---|---|
| 449464 | * | 10/1991 | (EP) | 49/49 |
| 2231844 | * | 12/1974 | (FR) | 49/49 |

* cited by examiner

*Primary Examiner*—Jerry Redman
(74) *Attorney, Agent, or Firm*—Banner & Witcoff, Ltd.

(57) ABSTRACT

A railroad crossing gate mechanism is provided that includes a gate arm adapter which is pivotally mounted to allow a lowered gate arm to rotate away from a generally perpendicular force in a generally horizontal plane. The gate arm mechanism further includes multiple interchangeable spring assemblies that generate a return force to bring a displaced gate arm back to its normal operating position, and a latch hook assembly for selectively latching the gate arm in its normal position and controlling the rate of return of the gate arm from a displaced position through application of a pivotally leveraged force to a braking surface.

16 Claims, 4 Drawing Sheets

CROSSING GATE ARM PROTECTION ASSEMBLY

CROSS-REFERENCE TO RELATED APPLICATION

Pursuant to 35 U.S.C. § 119(e), this application claims priority from Provisional Application No. 60/149,841, filed Aug. 19, 1999.

FIELD OF THE INVENTION

The invention relates generally to an improved gate device for preventing pedestrians and vehicular traffic from crossing railroad grades. Specifically, the present invention relates to gate devices that protect lowered railroad crossing gate arms from damage.

BACKGROUND OF THE INVENTION

Railroad crossing gate arms are lowered from a vertical position to a horizontal position to block traffic from crossing railroad tracks when a train is present. When lowered to their horizontal position, gate arms can suffer damage from passing vehicles, wind pressure and vandalism. Damage frequently results in broken gate arms that sever at their point of attachment to a crossing gate mechanism. Such damage risks exposing pedestrians and vehicular traffic to improperly guarded train crossings. To maintain safety and the integrity of grade crossing equipment, railroads expend substantial resources monitoring, repairing and replacing damaged crossing gates. Thus, in the first instance, it is advantageous to protect lowered gate arms from damage.

Various methods of protecting gate arms from damage were known to the prior art. Employing camblocks and ball bearings, U.S. Pat. No. 4,897,960 issued to Barvinek, et al., (hereinafter referred to as "Barvinek") describes a mechanism designed to provide flexibility to lowered gate arms. Barvinek discloses a housing for pivotally mounting a support tube that swings a partially translucent, internally illuminated, impact-resistant gate arm away from an applied force. A camblock is mounted inside the housing, allowing the gate arm support tube, having a pair of ball bearings retained within, to rotate around a retaining pin that extends upwardly through the center of the camblock when force from a passing vehicle is applied. Downward force on the rotating gate arm support tube, applied by a coil spring mounted on the retaining pin, forces the arm to return to its original position parallel with the groove of the camblock when the force dissipates. However, Barvinek suffers from numerous problems. Relying on camblocks and ball bearings, Barvinek is expensive to manufacture, monitor and maintain. Moreover, Barvinek cannot return a displaced gate arm to a position parallel with the groove of the camblock if the gate mechanism rises while the gate is displaced. Finally, Barvinek provides no control over the rate of gate arm return and cannot prevent gate arm over travel into the flow of traffic.

Alternatively, U.S. Pat. No. 5,469,660, issued to Tamenne, (hereinafter referred to as "Tamenne") employs a spring and hydraulic piston system. Tamenne discloses a pivot assembly allowing a lowered gate arm to rotate away from traffic when a passing vehicle applies pressure and then to return to its original position once pressure is removed. The pivot assembly is mounted on a counter-weighted gate arm mechanism and includes springs mounted on a shuttle post assembly to return the gate arm to a position perpendicular to the flow of traffic. The pivot assembly includes a hydraulic piston to buffer the rate of gate arm return and a weight channel to counterbalance the gate mechanism's main counterweight when the gate arm is rotated away from passing traffic. However, Tamenne also suffers from numerous problems. Tamenne's hydraulic piston system, like Barvinek's camblock and ball bearing system, is expensive to manufacture, monitor and maintain. Further, Tamenne's weight channel counterbalance places an imbalanced strain on the gate arm pivot assembly, risking damage to the gate arm mechanism. Tamenne also decreases safety at crossing grades when the gate arm is displaced, because the weight channel swings from a position generally parallel with the flow of traffic to a position generally perpendicular to the flow of traffic and through an area where pedestrians may be standing. Like Bamivek, Tamenne is incapable of returning a displaced gate arm back to its normal position if the gate mechanism rises while the gate is displaced.

Therefore, a need exists for a crossing gate mechanism that can rotate a crossing gate arm out of the way of a damaging force while safely and efficiently returning the gate to its normal position, that is capable of being adjusted for installation in conditions requiring varied gate arm lengths and flexibilities, that is capable of preventing excessive impact when the gate arm returns to its normal position, that prevents gate arm over travel upon return from a displaced position, that is capable of being adjusted for varying gate arm return force requirements, that is less expensive than existing spring-based crossing guard mechanisms, and that is not subject to the potential for deterioration of a cam-and-bearing based crossing gate mechanisms.

SUMMARY OF THE INVENTION

The present invention provides a crossing gate mechanism for use in a railroad crossing gate. In one embodiment, the crossing gate mechanism includes a gate arm adapter for receiving the gate arm and allowing rotation of the gate arm away from a normal operating position approximately perpendicular to a flow of traffic upon application of a displacement force. The gate arm adapter is capable of being pivotally mounted to a vertical support structure to allow the rotation of the gate arm. A return force mechanism coupled to the gate arm adapter provides for a return of a displaced gate arm adapter to the normal operating position upon removal of the displacement force. In the one embodiment, the crossing gate mechanism further includes a latch hook assembly that holds the gate arm adapter in its normal operating position in the absence of a displacement force. In another embodiment, the crossing gate mechanism further includes a drag brake that retards a rate of return of the gate arm adapter to the normal operating position from a displaced position upon removal of the displacement force.

In another embodiment, the crossing gate mechanism includes a crossing gate arm, the gate arm adapter, and a return force mechanism attachment point. The gate arm adapter receives the crossing gate arm and includes a hinge pin that allows rotation of the gate arm away from the normal operating position upon application of the displacement force. The return force mechanism attachment point is diametrically opposite the hinge pin from the gate arm, and the return force mechanism attachment point, the hinge pin, and the gate arm are disposed in a generally linear relationship.

In another embodiment, the crossing gate mechanism includes a latch hook assembly. The latch hook assembly includes a pivotally levered latch that selectively restrains the gate arm adapter in its normal operating position, and a latch hook pressure mechanism that applies a leveraging force to the pivotally mounted latch to produce a pivotally levered force of the latch. The latch hook assembly further includes a hook and drag surface that receives the pivotally levered force of the latch upon application of a displacement force to the crossing gate mechanism.

DETAILED DESCRIPTION OF THE PREFERRED EMBODIMENT

Figure 1:
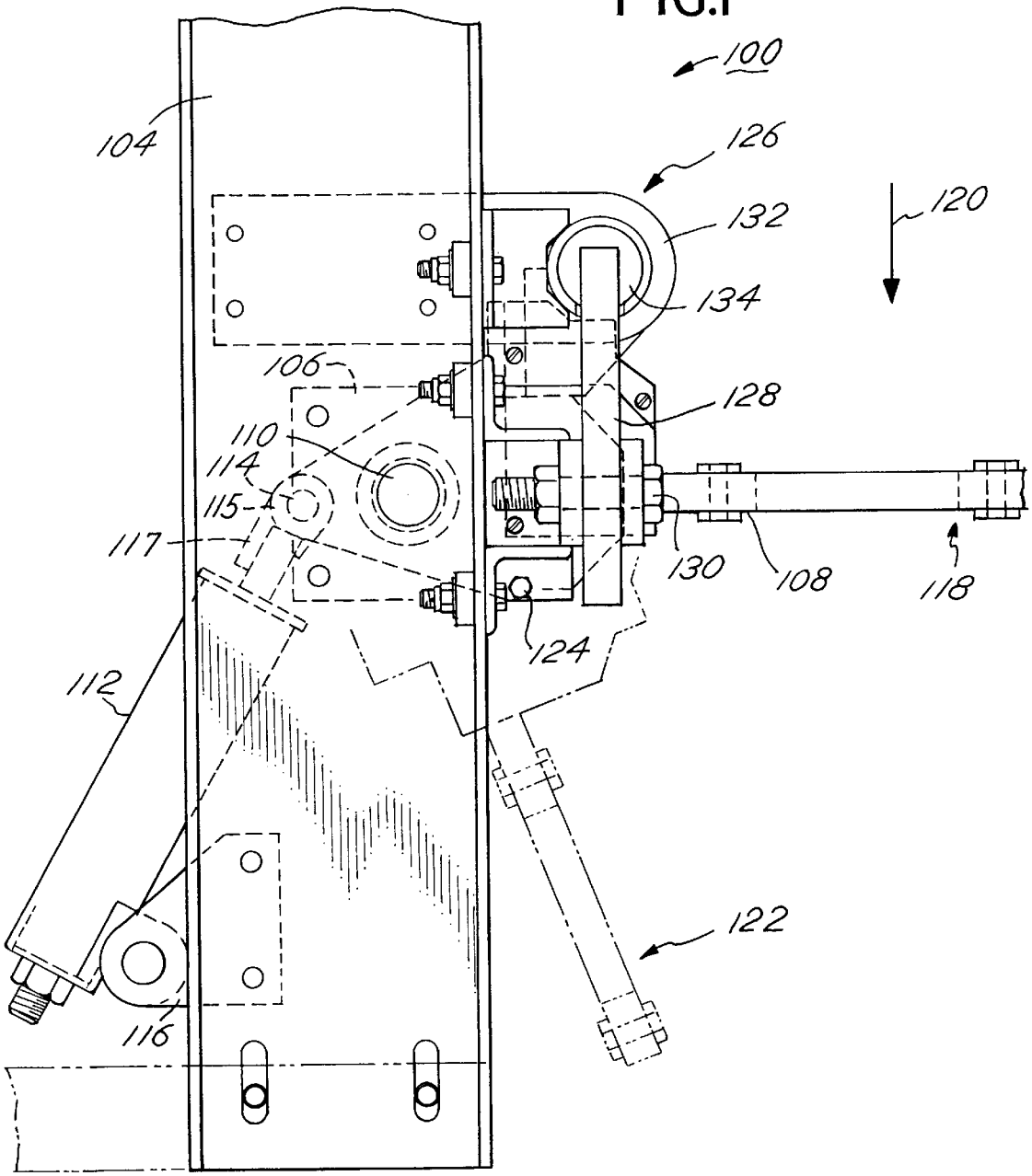
FIG. 1 is a partial top view of a crossing gate mechanism in accordance with a preferred embodiment of the present invention.
Figure 2:
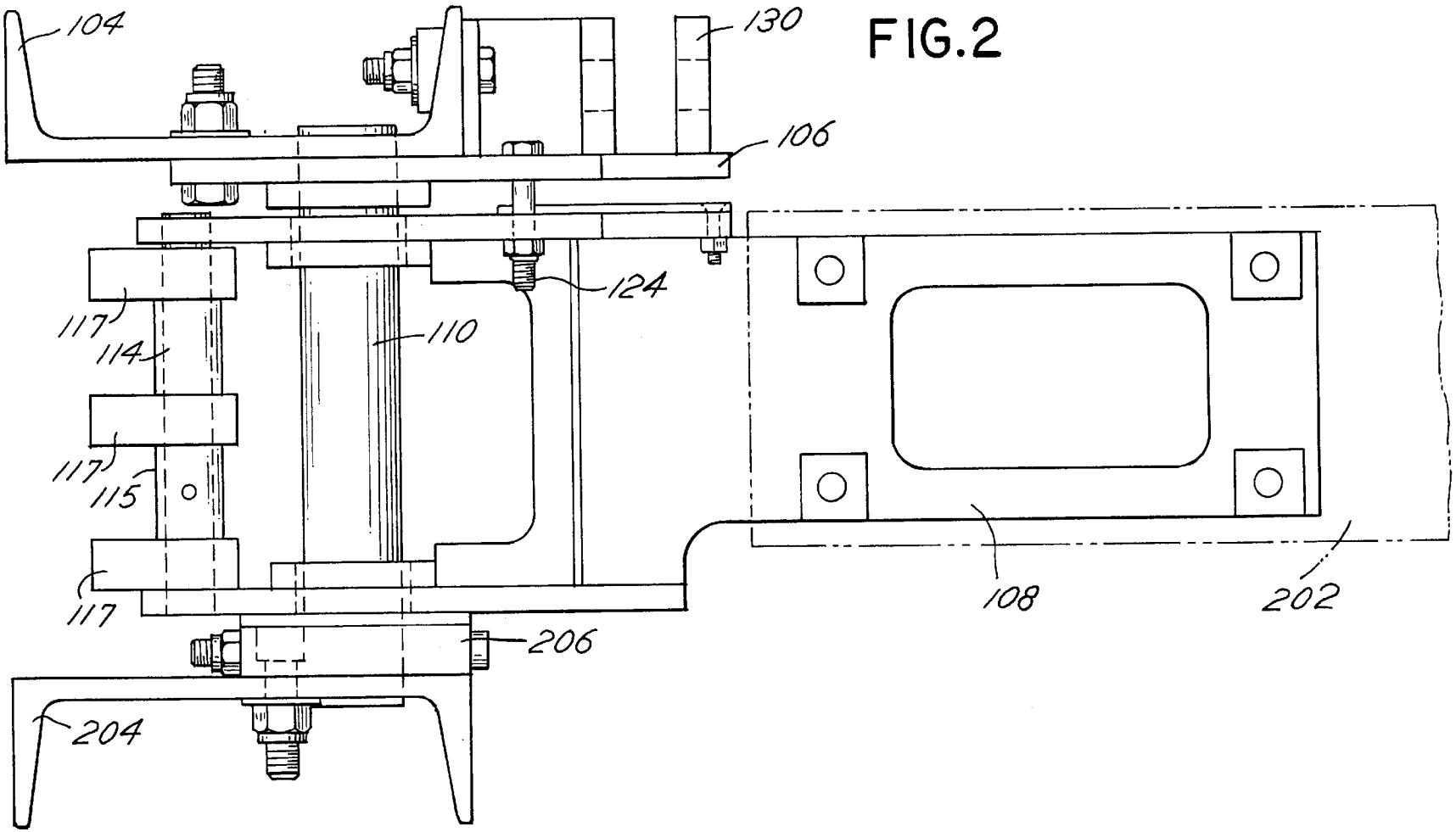
FIG. 2 is a partial side view of a crossing gate mechanism in accordance with a preferred embodiment of the present invention.

The present invention can be more fully understood with reference to FIGS. 1–4. FIGS. 1 and 2 are a partial top view and a partial side view, respectively, of a crossing gate mechanism 100 in accordance with a preferred embodiment of the present invention. Crossing gate mechanism 100 is pivotally mounted to a vertical support that also typically serves as a mounting support for railroad crossing warning lights and signage. Crossing gate mechanisms such as crossing gate mechanism 100 are typically attached to the vertical support by two crossing gate support arms 102 (one shown).

The crossing gate support arms 102 are attached to crossing gate mechanism 100 at opposite ends of the mechanism and raise and lower the crossing gate mechanism, thereby raising and lowering a crossing gate arm 202 attached to the crossing gate mechanism, in a vertical plane. Normally, crossing gate mechanism 100 is in an upright position, holding crossing gate arm 202 in a generally vertical orientation and allowing vehicles to proceed through a railroad crossing in the absence of train traffic. When actuated by an oncoming train, crossing gate mechanism 100 lowers crossing gate arm 202, bringing crossing gate arm 202 into a position approximately parallel to the ground, in order to block vehicular traffic from proceeding through the crossing.

As shown in FIGS. 1 and 2, crossing gate mechanism 100 includes an upper cross channel 104 and a lower cross channel 204. Each cross channel 104, 204 is attached to each of the crossing gate support arms (e.g., crossing gate support arm 102), thereby pivotally affixing crossing gate mechanism 100 to the vertical support. Cross channels 104, 204 are fitted with an upper hinge bracket 106 and a lower hinge bracket 206 that are generally centered between crossing gate support arms 102. Crossing gate mechanism 100 further includes a gate arm adapter 108 that is pivotally mounted to each cross channel 104, 204 via a hinge pin 110. As shown in FIG. 2, hinge pin 110 is perpendicularly disposed between, and extends through an aperture in, each of cross channels 104, 204 and hinge brackets 106, 206.

Crossing gate mechanism 100 further includes a return force mechanism that includes one or more, preferably three, spring assemblies 112. Each spring assembly 112 is pivotally attached to the gate arm adapter 108 via a spring assembly hinge pin sleeve 115 and a spring assembly hinge pin 114. Spring assembly hinge pin sleeves 115 fit over spring assembly hinge pin 114 acting as spacers to separate spring assembly adapters 117. Using a fastener through a lower sleeve hole and the spring assembly hinge pin 114, all parts stay in place within the top and bottom flanges of the gate arm adapter 108. Spring assemblies 112 attach to the cross channels 104,204 via mounting flanges 116 using a similar pin and sleeve arrangement as just described. Spring assembly adapters 117 each provide an attachment point for the mounting of a spring assembly 112, thereby providing for each spring assembly 112 to be pivotally attached to gate arm adapter 108. In a preferred embodiment, gate arm adapter 108 is allowed to rotate about hinge pin 110 while the length of crossing gate arm 202, hinge pin 110 and spring assembly hinge pin 114 and sleeve 115 maintain a generally linear relationship throughout rotation.

FIG. 1 further illustrates the typical operating positions of crossing gate mechanism 100 when it is in its lowered and approximately horizontal position relative to the ground. Reference position 118 indicates a normal operating position of lowered crossing gate mechanism 100, wherein gate arm adapter 108 is generally perpendicular to the flow of vehicular traffic (as indicated by an approximately horizontal displacement force 120). Reference position 122 indicates a displaced position of lowered gate arm adapter 108, achieved when displacement force 120 is applied to gate arm 202, causing gate arm adapter 108 to rotate the gate arm 202 in an approximately horizontal plane about hinge pin 110. By rotating crossing gate arm 202, crossing gate mechanism 100 protects the gate arm 202 from potential damage due to the application of displacement force 120. Preferably, the maximum angle of swing during displacement is approximately 68°; however, one of ordinary skill in the art realizes that other angles than 68° may be employed without departing from the spirit or scope of the present invention.

When displacement force 120 displaces gate arm adapter 108 from normal operating position 118, each spring assembly 112 provides an approximately horizontal return force on gate arm adapter 108 at spring assembly hinge pin 114. The return force causes gate arm adapter 108 and gate arm 202 to return from a displaced position 122 back into normal operating position 118 after displacement force 120 is removed. In a preferred embodiment, crossing gate mechanism 100 includes an interchangeable selection of spring assemblies 112 to provide more or less return force for returning longer or shorter gate arms 202 from the displaced position 122 to the normal operating position 118. Spring assemblies 112 preferably provide adequate return force on gate arm adapter 108 so that gate arm 202 can be returned from a displaced position 122 to normal position 118 even if crossing gate mechanism 100 pivots in the vertical plane about its vertical support, as if to raise gate arm 202 while the gate arm is displaced.

In a preferred embodiment, crossing gate mechanism 100 further includes a shear pin 124 that is coupled between upper hinge bracket 106, or alternatively lower hinge bracket 206, and gate arm adapter 108. Shearpin 124 provides crossing gate mechanism 100 with additional resistance to gate arm 108 rotation in high wind areas, yet will easily shear upon impact with displacement force 120.

Figure 3:
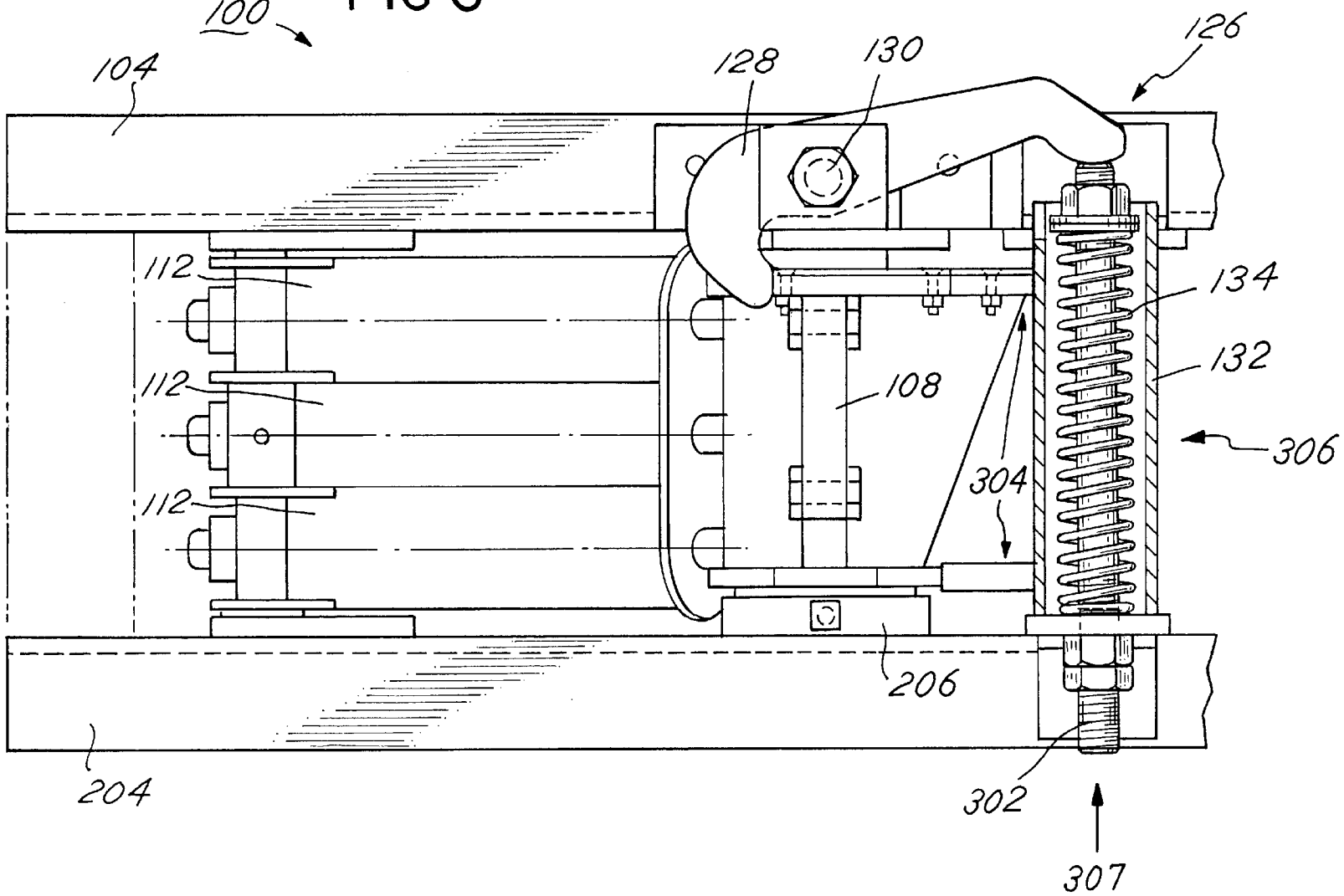
FIG. 3 is a partial front view of a crossing gate mechanism in accordance with a preferred embodiment of the present invention.

Referring now to FIGS. 1, 2 and 3, wherein FIG. 3 is a partial front view of crossing gate mechanism 100 in accordance with a preferred embodiment of the present invention, crossing gate mechanism 100 further includes a latch hook assembly 126. Latch hook assembly 126 latches gate arm adapter 108 in normal operating position 118 in the absence of displacement force 120 and serves to retard the rate of return of gate arm adapter 108 from displaced position 122. Latch hook assembly 126 includes a latch hook 128 that is pivotally mounted to upper hinge bracket 106, or alternatively to lower hinge bracket 206, at a latch hinge 130. Latch hook assembly 126 further includes a latch hook pressure mechanism 306 that applies a leveraging force to latch hook 128. Latch hook pressure mechanism 306 includes a latch spring housing 132 attached to cross channel 104, and/or cross channel 204, and a latch spring 134 retained within a latch spring housing 132 by a latch spring retaining bolt 302. Latch spring housing 132 includes one or more, preferably two, gate arm adapter stops 304 that serve as a positive return stop for the gate arm adapter 108 when the adapter is displaced by displacement force 120, preventing gate arm 108 over travel beyond the normal operating position 118 upon return from displaced position 122.

Latch hook assembly 126, as shown in FIG. 3, latches gate arm adapter 108 in normal operating position 118 in the absence of displacement force 120. Latch spring 134 transmits a leveraging force (in a direction indicated by arrow 307) to latch hook 128 via latch spring retaining bolt 302. The leveraging force, transmitted by latch spring 134 through latch spring retaining bolt 302 to latch hook 128, latches gate arm adapter 108 in normal operating position 118. Preferably, latch hook 128 will remain latched to gate arm adapter 108 by the leveraged force of latch spring 134 through a minor rotation, such as 8° to 10°, out of the normal operating position 118 of gate arm 202, allowing crossing gate mechanism to absorb a minor horizontal displacement force without unlatching. Those of ordinary skill in the art will realize that other angles than 8° to 10° may be employed without departing from the spirit or scope of the present invention.

Figure 4:
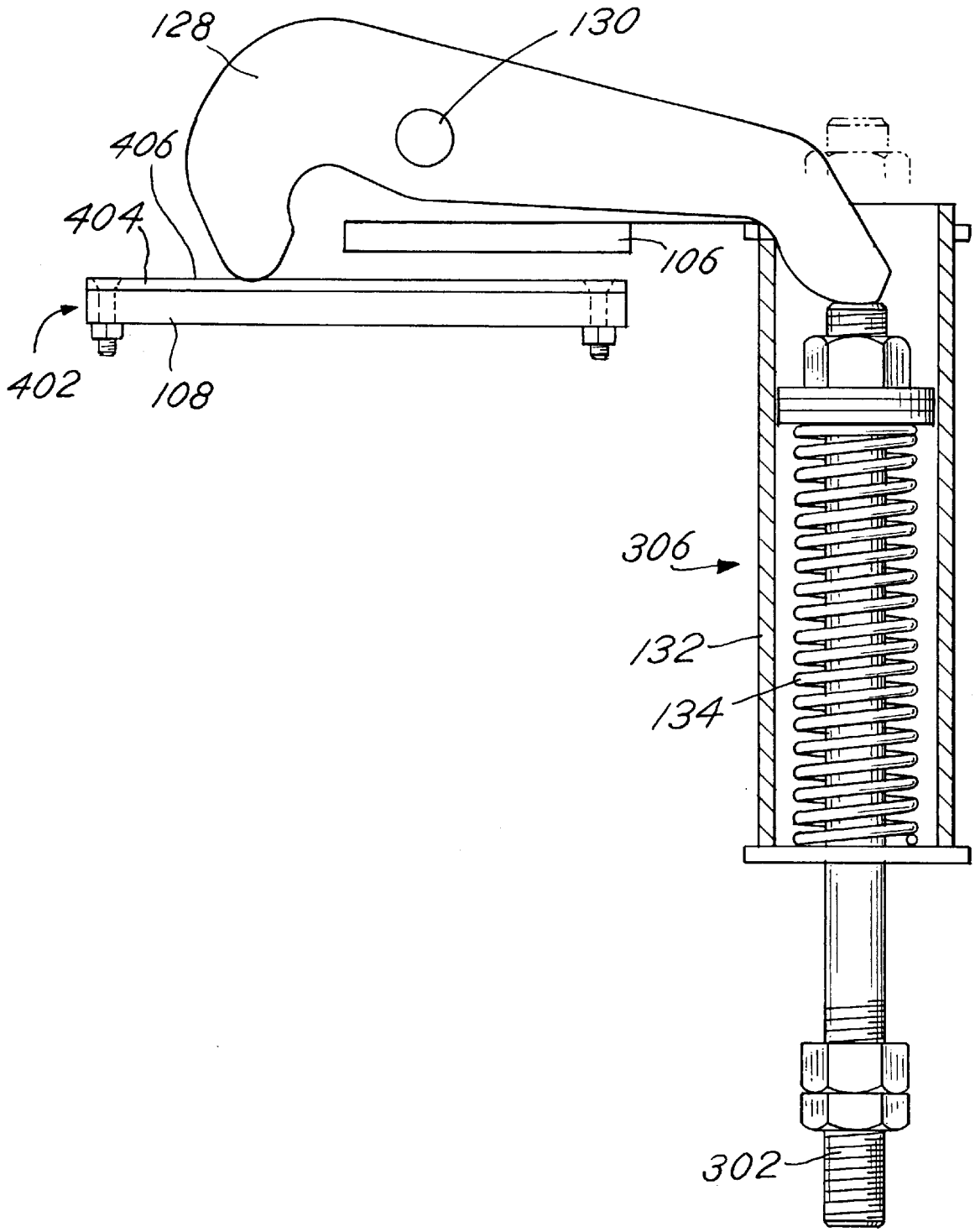
FIG. 4 is a partial front view of a latch hook assembly when operating as a braking mechanism in accordance with a preferred embodiment of the present invention.

FIG. 4 is a partial front view of latch hook assembly 126 when operating as a braking mechanism in accordance with a preferred embodiment of the present invention. Latch hook assembly 126, as shown in FIG. 4, operates as a drag brake, retarding the rate of return of gate arm adapter 108 to normal operating position 118 when the adapter is in displaced position 122. When displacement force 120 is applied to gate arm 108 causing gate arm adapter 108 to rotate out of its normal operating position 118, gate arm adapter 108 applies an upward force on an end of latch hook 128 opposite the end disposed next to latch spring retaining bolt 302. The upward force causes latch hook 128 to pivot about latch hinge 130, depressing latch spring retaining bolt 302 and compressing latch spring 134 until latch hook 128 releases gate arm 108. A brake plate 402, fitted with a replaceable wear plate 404 that presents a hook and drag surface 406 to latch hook 128, is mounted on gate arm adapter 108 to receive the pivotally levered force of latch hook 128 when gate arm adapter 108 is displaced from normal operating position 118.

Pressure transmitted by latch spring 134 through latch hook 128 to gate arm adapter 108 via wear plate 404 causes a frictional contact between latch hook 128 and hook and drag surface 406 as the gate arm adapter 108 returns from displaced position 122 to normal operating position 118 and latch hook 128 correspondingly translates across hook and drag surface 406. The frictional contact retards the return of gate arm adapter 108. By retarding the rate of return of gate arm adapter 108 from displaced position 122 under power from spring assemblies 112, latch hook assembly 126 operates as a drag brake and prevents excessive impact between gate arm adapter 108 and latch spring housing 132 at stops 304. One of ordinary skill in the art realizes that a variety of latch springs 134 are available to provide more or less retarding force on gate arm adapter 108 and brake plate 402 through levered latch hook 128. Upon return of gate arm assembly 108 to normal operating position 118, latch hook assembly 126 returns to the position shown in FIG. 3.

In sum, the present invention provides a crossing gate mechanism 100 that can rotate a crossing gate arm 202 out of the way of a damaging force while safely and efficiently returning the gate arm to its normal operating position 118. Crossing gate mechanism 100 includes a latch hook assembly 126 that latches the gate arm in normal operating position 118. Crossing gate mechanism 100 further includes a return force mechanism that includes multiple spring assemblies 112 that returns the gate arm 202 to the normal operating position after the gate arm has been displaced by a displacing force 120. By varying the number of spring assemblies 112 used in the return force mechanism, or by using spring assemblies that apply a greater or lesser return force, crossing gate mechanism 100 is capable of being adjusted for installation in conditions requiring varied gate arm lengths and flexibilities and is capable of being adjusted for varying gate arm return force requirements. Latch hook assembly 126 also operates as a drag brake that is capable of preventing excessive impact when gate arm 202 returns to its normal operating position from a displaced position 122.

Crossing gate mechanism 100 also includes return stops 304 that prevent gate arm over travel upon return from a displaced position 122. By employing a drag brake, as opposed to a hydraulic piston of the prior art, to retard the rate of return of the gate arm 202 from a displaced position 122, the present invention is less expensive than existing spring-based crossing guard mechanisms. Furthermore, by employing a return force mechanism that includes one or more spring assemblies applying an approximately horizontal return force when crossing gate mechanism 100 is in an approximately horizontal position, the potential for deterioration of a cam-and-bearing based crossing guard mechanism is eliminated.

While the present invention has been particularly shown and described with reference to particular embodiments thereof, it will be understood by those skilled in the art that various changes in form and details may be made therein without departing from the spirit and scope of the present invention.

What is claimed is:

1. A crossing gate assembly which that is lowered when detecting the presence of a train, said gate assembly having a support structure and a crossing gate arm normally pivotally mounted on said support structure about a first axis spaced from and substantially aligned with a normal flow path of traffic past said crossing gate assembly, and wherein said gate arm is pivotal about said first axis between a raised, open position for allowing the flow of traffic past said gate assembly and a lowered position for blocking the flow path of traffic past said gate assembly; an improved gate arm mechanism comprising:

a crossing gate arm adapter for supporting said gate arm, said gate arm adapter and said gate arm being pivotal about said first axis, said gate arm adapter with said gate arm thereon being pivotally mounted on said support structure which moves about a second axis transverse to said first axis, said gate arm adapter and said gate arm both being pivotal about said second axis between said lowered, blocking position and a displaced position responsive to a displacement force against said gate arm in a direction substantially aligned with said flow path of traffic, a return force mechanism coupled to said gate arm adapter returning said gate arm adapter with said gate arm to said lowered, blocking position of said gate arm upon removal of said displacement force; and a latch hook assembly that holds the gate arm adapter in an operating position in an absence of said displacement force.

2. The crossing gate mechanism of claim 1, wherein the latch hook assembly comprises a latch hook that holds the gate arm adapter in said normal position in the absence of the displacement force.

3. The crossing gate mechanism of claim 1, wherein the latch hook assembly includes a stop that prevents the gate arm adapter over travel upon return of said gate arm from a displaced position.

4. The crossing gate mechanism of claim 1, wherein the latch hook assembly further retards the rate of return of the gate arm adapter and gate arm from a displaced position upon removal of the displacement force.

5. The crossing gate mechanism of claim 4, wherein the latch hook assembly further comprises a latch hook pressure mechanism that is disposed in contact with the latch hook assembly and applies a leveraging force to the latch hook assembly, wherein the leveraging force causes the latch hook assembly to apply a levered force to the gate arm adapter that retards a return of the gate arm adapter and gate arm to the normal operating position from a displaced position upon removal of the displacement force.

6. The crossing gate mechanism of claim 5, wherein the latch hook pressure mechanism comprises a latch spring that applies a leveraging force to the latch hook.

7. The crossing gate mechanism of claim 5, further comprising a wear plate affixed to the gate arm adapter for receiving the levered force of the latch hook.

8. The crossing gate mechanism of claim 1, wherein said return force mechanism comprises a spring assembly that is pivotally mounted to the gate arm adapter and wherein the spring mechanism applies an approximately horizontal return force to the gate arm adapter when the gate arm adapter is displaced from a normal operating position perpendicular to the flow of traffic.

9. The crossing gate mechanism of claim 1, wherein said latch hook assembly comprises:

a pivotally levered latch that selectively restrains said gate arm adapter in its normal operating position;

a latch hook pressure mechanism that applies a leveraging force to said pivotally mounted latch to produce a pivotally levered force of the latch; and a hook and drag surface that receives the pivotally levered force of the latch upon application of a displacement force to the crossing gate mechanism.

10. The crossing gate mechanism latch hook assembly of claim 9, further comprising a latch hook assembly housing that provides a positive mechanical stop for the gate arm adapter and that prevents gate arm adapter over travel beyond the normal operating position.

11. The crossing gate assembly of claim 1 wherein said gate arm adaptor and said gate arm are pivotal about said second axis in the raised position, in the lowered position and in positions therebetween.

12. A crossing gate mechanism comprising:

a gate arm adapter for receiving a gate arm, wherein the gate arm adapter is capable of being pivotally mounted to a vertical support structure to allow rotation of the gate arm away from a normal operating position approximately perpendicular to a flow of traffic upon application of a displacement force;

a return force mechanism coupled to the gate arm adapter that provides for a return of a displaced gate arm adapter to a normal operating position upon removal of the displacement force; and a drag brake that retards a rate of return of the gate arm adapter to the normal operating position from a displaced position upon removal of the displacement force, said drag brake including:

a latch hook;

a latch hook pressure mechanism that is disposed in contact with the latch hook and that applies a leveraging force to the latch hook; and wherein the leveraging force causes the latch hook to apply a levered force to the gate arm adapter that retards a rate of return of the gate arm adapter to the normal operating position from a displaced position upon removal of a displacement force.

13. The crossing gate mechanism of claim 12, wherein the latch hook pressure mechanism comprises:

a compressed spring assembly that applies a leveraging force to the latch hook; and a compressed spring assembly housing that houses the compressed spring assembly.

14. The crossing gate mechanism of claim 12, further comprising a wear plate affixed to the gate arm adapter for receiving the levered force from the latch hook.

15. A crossing gate assembly which that is lowered when detecting the presence of a train, said gate assembly having a support structure and a crossing gate arm normally pivotally mounted on said support structure about a first axis spaced from and substantially aligned with a normal flow path of traffic past said crossing gate assembly, and wherein said gate arm is pivotal about said first axis between a raised, open position for allowing the flow of traffic past said gate assembly and a lowered position for blocking the flow of traffic past said gate assembly; an improved gate arm mechanism comprising:

a crossing gate arm adapter for supporting said gate arm for movement about said first axis;

a substantially upright hinge pin mounted on said adapter pivotally supporting said arm about a second axis defined by said upright hinge pin; said gate arm being pivotal about said hinge pin and about said second axis for movement of said gate arm away from the flow path of traffic upon application of a displacement force; and a return force mechanism mounted on said adapter, being rotatable about an attachment point and being spaced from said hinge pin in a direction opposite the mounting position of said gate arm relative to said gate arm, said attachment point, said hinge pin and said gate arm being disposed in a generally linear relationship.

16. The gate arm mechanism of claim 15 wherein said return force mechanism includes a spring assembly for returning the displaced gate arm to the normal operating position upon removal of the displacement force.

* * * * *